United States Patent [19]

Bigelow

[11] 4,147,102

[45] Apr. 3, 1979

[54] PRESS

[76] Inventor: John W. Bigelow, 16219 Blackwood, Valinda, Calif. 91744

[21] Appl. No.: 876,368

[22] Filed: Feb. 9, 1978

[51] Int. Cl.[2] ..... B30B 1/26

[52] U.S. Cl. ..... 100/257; 100/292

[58] Field of Search ..... 100/257, 219, 292, 265, 100/266; 11/1 B

[56] References Cited

U.S. PATENT DOCUMENTS

| | | | |
|---|---|---|---|
| 505,093 | 9/1893 | Clarke | 100/292 X |
| 514,204 | 2/1894 | Taylor | 100/257 |
| 543,731 | 7/1895 | Hempsted | 100/282 |
| 1,126,325 | 1/1915 | Westenhiser | 100/292 X |
| 1,184,904 | 5/1916 | Westenhiser | 100/292 X |
| 1,203,946 | 11/1916 | Westenhise | 100/292 X |
| 1,270,111 | 6/1918 | Brittain | 100/292 X |
| 1,366,516 | 1/1921 | Brittain | 100/257 |
| 1,856,885 | 5/1932 | Rasmussen | 100/292 |
| 2,526,987 | 10/1950 | Wilson | 100/257 X |
| 3,986,447 | 10/1976 | Zimmer | 100/257 X |

*Primary Examiner*—Billy J. Wilhite

*Attorney, Agent, or Firm*—Poms, Smith, Lande, Glenny & Rose

[57] ABSTRACT

A press for clamping order blank pads, or the like, for gluing, includes upper and lower press plates and arrangements for applying firm clamping pressure to a stack of pads, with a few up to a large number of pads included in the stack, with a single motion of a clamping lever. The weight of the upper press plate is counterbalanced with an extension spring and parallelogram-type arrangement, whereby the upper press plate will remain in a fixed position wherever the operator locates it, so that the order blank pads to be clamped and glued may easily be placed in position between the two press plates. In the course of the clamping operation, a pressure clamping assembly associated with the movable upper press plate is initially engaged with a pair of threaded support members, and then further movement of the clamping lever provides camming action between the pressure clamping assembly and the upper press plate, pushing the upper press plate down to firmly clamp the order blanks between the upper and lower press plates.

10 Claims, 5 Drawing Figures

PRESS

FIELD OF THE INVENTION

This invention relates to presses and more particularly to presses for clamping material, such as order blank pads, together while they are being glued.

BACKGROUND OF THE INVENTION

A common problem in connection with the clamping of stacks of material is that of clamping a stack of material which may vary widely in over-all thickness, but still firmly applying high pressure to the stack of material, whatever its thickness. A number of patents which appear to be broadly directed to this problem include G. E. Clarke, U.S. Pat. No. 505,093; J. H. Taylor, U.S. Pat. No. 514,204; G. F. Westenhiser, U.S. Pat. No. 1,126,325; O. F. Westenhiser, U.S. Pat. No. 1,184,904; S. W. Hempsted, U.S. Pat. No. 543,731; O. F. Westenhiser, U.S. Pat. No. 1,203,946; and H. V. Rasmussen, U.S. Pat. No. 1,856,885. In reviewing the various references, the Clarke patent, No. 505,093 is a letter press which includes a relatively complex mechanical mechanism with a ratchet mechanism, dogs for engaging the ratchet mechanism, an eccentric for raising the platen, a camming mechanism for releasing the dogs, and fulcrum arrangements to permit raising the head forming part of the letter press. The mechanism included in the Clarke patent appears to be relatively complex, and the mode of operation is by no means clear from the brief 1893 specification of this patent. Concerning the remaining patents, the mechanism for locating the upper clamping plate relative to the lower clamping plate appears to be entirely independent of the eccentric camming mechanism which is employed to apply pressure to the stack of material, in each of the patents.

Accordingly, an important object of the present invention is to provide a simple press apparatus for accommodating stacks of material of different thickness and for both initially clamping the upper press plate against vertical movement and thereafter applying substantial vertical pressure to the upper press plate to force the two press plates toward one another, using a single actuating lever.

BRIEF SUMMARY OF THE INVENTION

In accordance with the present invention, a press is provided with an upper press plate which may be adjusted over a wide range to accommodate various thicknesses of materials to be clamped. Mechanical arrangements are provided for operation with a single lever in order to first fix the upper press plate in its vertical position relative to the lower press plate and for thereafter applying camming force to said upper press plate to firmly clamp the material between the upper and lower press plates.

In accordance with a subordinate feature of the invention, mechanical arrangements are provided for opposing the weight of the upper plate so that it will remain in the position to which it may be adjusted.

In accordance with an additional feature of the invention, the press apparatus may be provided with two threaded rods, one on either side, and the upper press plate may have associated with it a pressure clamping assembly, which initially engages the threaded rods and subsequently exerts camming force downwardly on the upper press plate.

In accordance with another subordinate aspect of the invention, the weight of the upper press plate and clamping assembly may be opposed by a parallelgram-type structure with an extension spring applying inward force to pulleys mounted at two corners of the parallelgram-type structure.

Another feature of the invention involves the nature of the pressure clamping assembly. More specifically, it includes a cam with a constant radius camming portion during the initial portion of the throw of the clamping lever while the clamping assembly is being firmly locked in its vertical position; thereafter, during the subsequent portion of the "throw" of the clamping lever, the radius of the clamping cam increases significantly to force the upper clamping plate firmly downward to apply pressure to the material located between the upper and lower press plates.

Other objects, features, and advantages of the invention will become apparent from a consideration of the following detailed description, and from the accompanying drawings.

DETAILED DESCRIPTION

Figure 1:
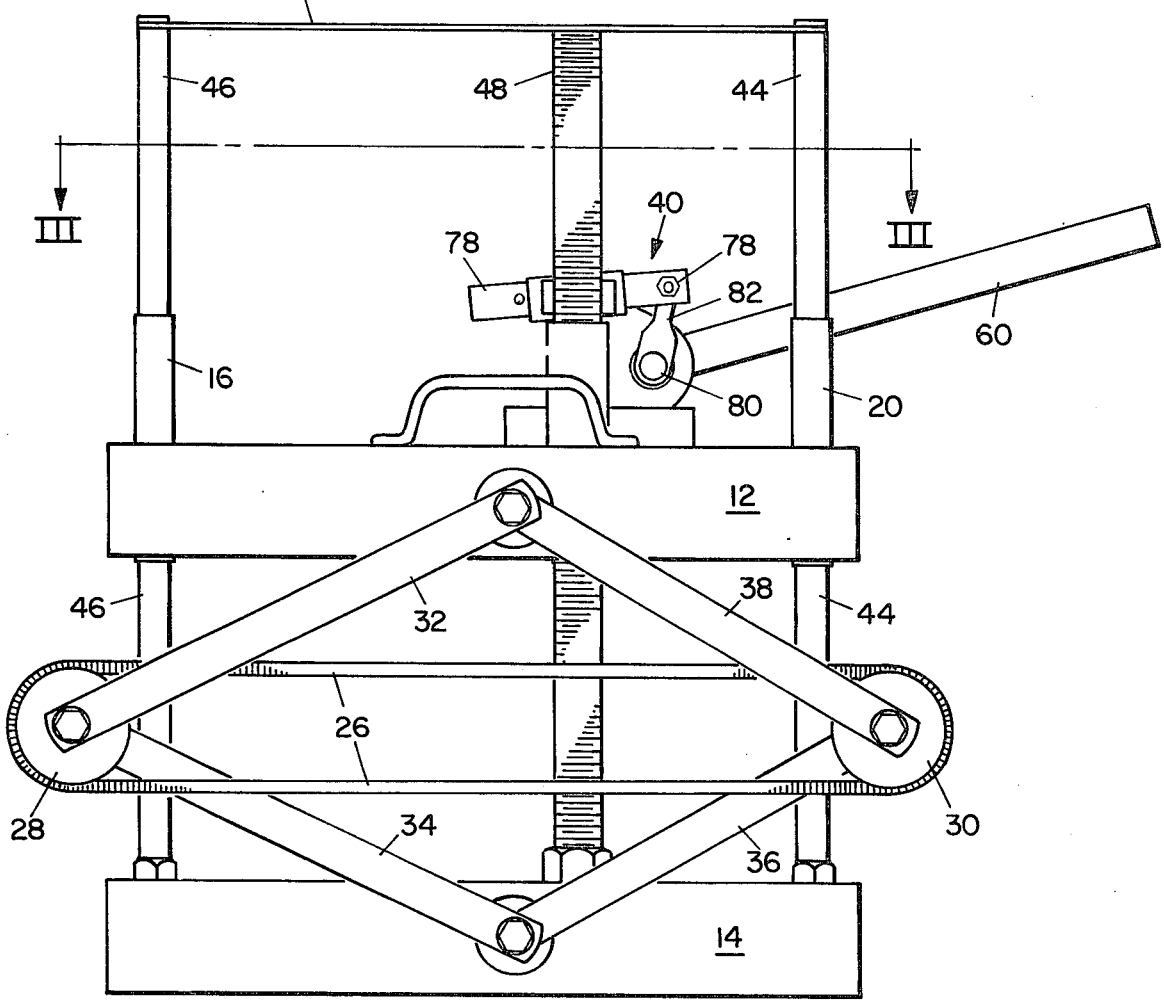
FIG. 1 is an end view of a press illustrating the principles of the present invention.

Referring more particularly to the drawings, in the side view of FIG. 1, the upper press plate 12 is shown spaced from the lower press plate 14. Secured to the upper press plate 12 are three tubular sleeves 16, 18, and 20 located at the near end of the press assembly, with an additional set of three tubular guide members being located at the far end of the assembly, not visible in FIG. 1. When the press is to be employed in gluing a set of pads together, it is initially raised to a desired location by handles 22 and 24 (see FIG. 3). For convenience in the use of the press, the extension spring 26 is shown mounted on the pulleys 28 and 30 of the parallelgram-type assemblage made up of the four linkage members 32, 34, 36 and 38. The extension spring 26 is adjusted to apply sufficient inwardly directed force on the pulleys 28 and 30 to counteract the downward force of the weight of the upper press plate 12 and the associated pressure and clamping assembly 40.

Figure 2:
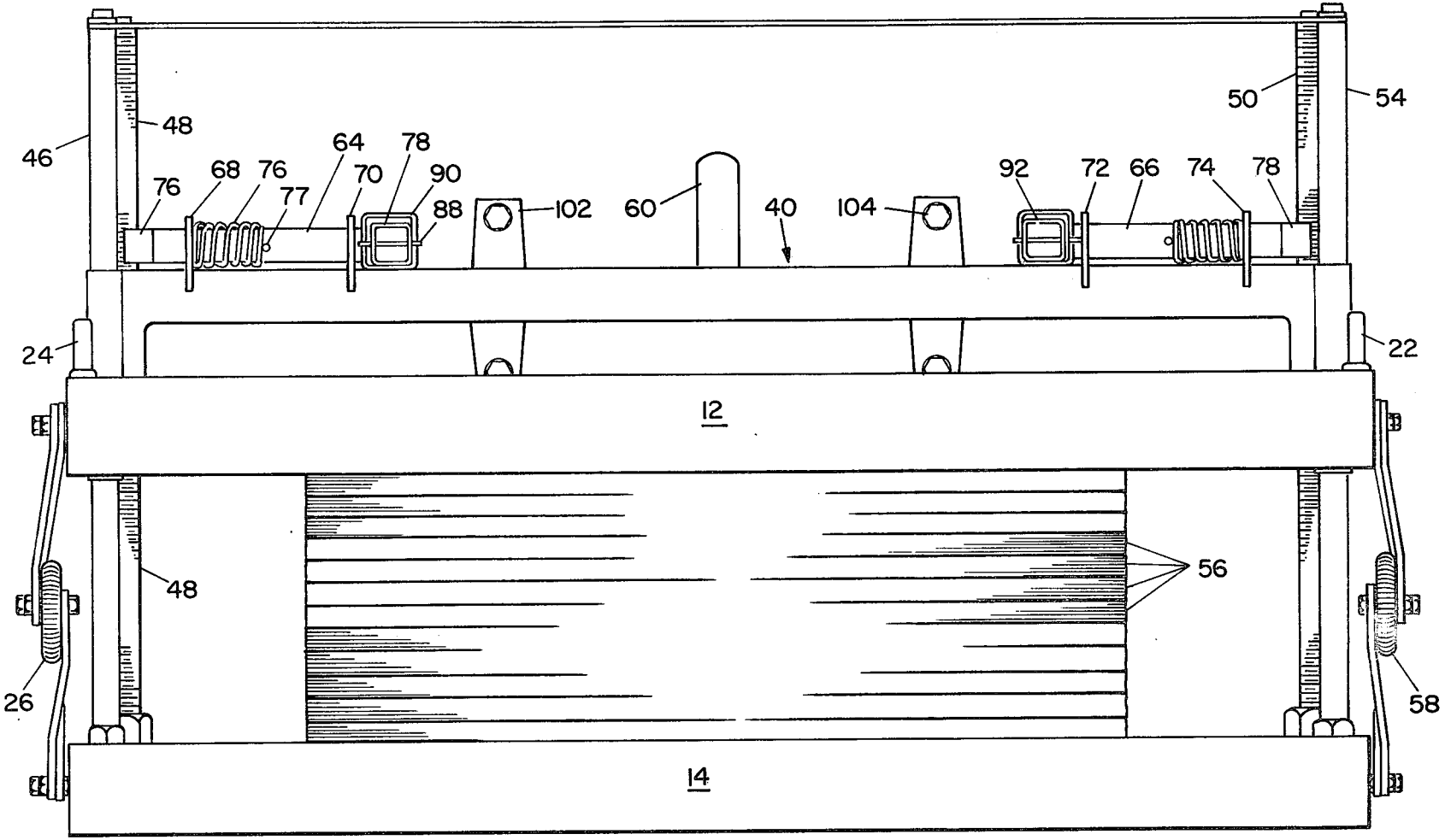
FIG. 2 is a side view of the press of FIG. 1 showing it in operation.
Figure 3:
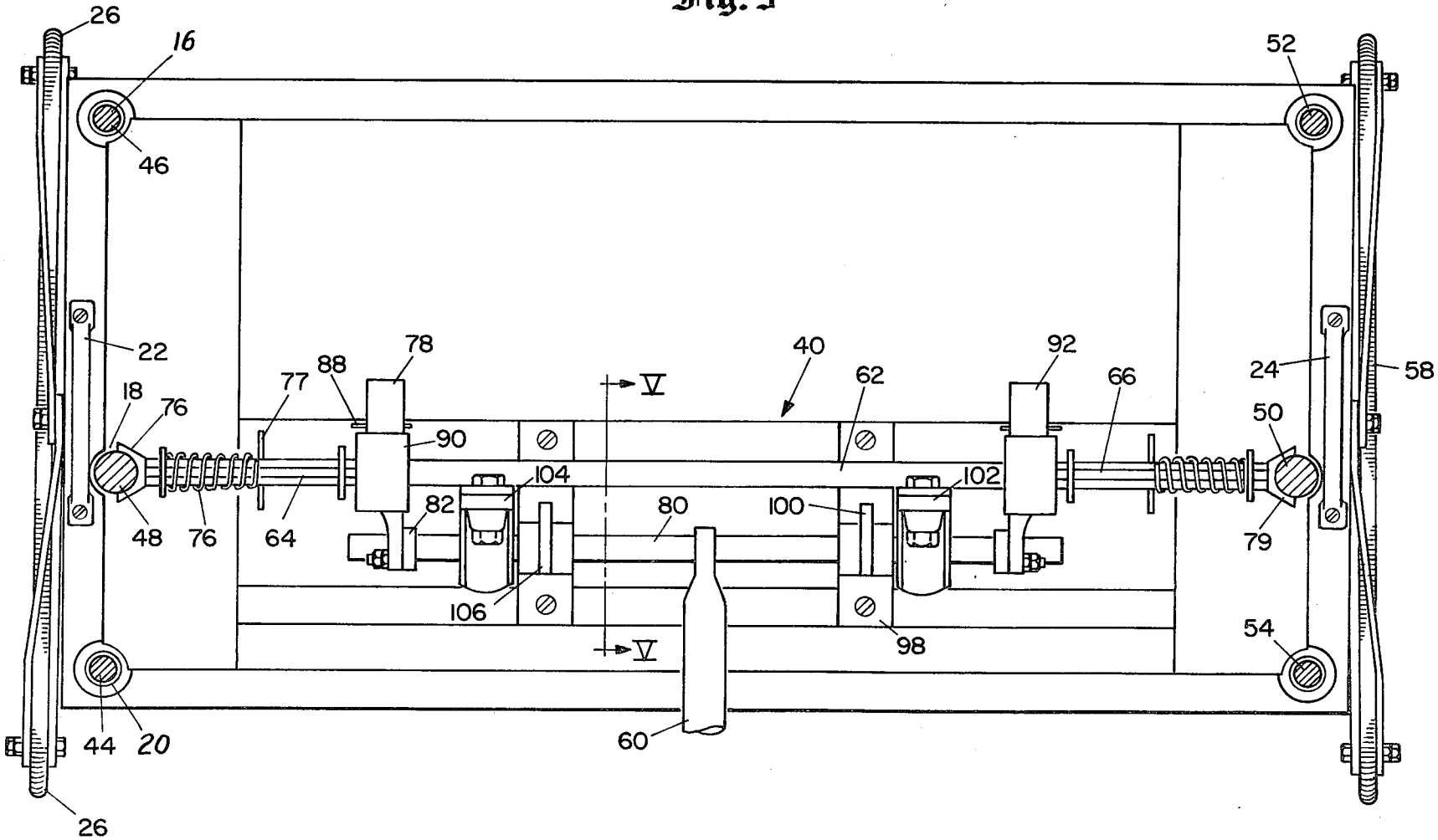
FIG. 3 is a top view of the press showing the mode of operation of the clamping assembly.

Concerning the relationships of FIGS. 2 and 3 with FIG. 1, FIG. 2 is a rear view taken from the left-hand side of FIG. 1, and FIG. 3 is a top view taken just below the top supporting brackets 42 to show the mode of operation of the clamping and pressure assembly 40.

For completeness, with reference to FIG. 3, the sleeves 16, 18 and 20 riding on the outer cylindrical metal rods 44 and 46, and the threaded shaft 48, may be noted. Similarly, the threaded shaft 50 at the other end of the assembly may be noted, as well as the two additional cylindrical metal rods 52 and 54 located at the corners of the assembly at the opposite end from metal rods 44 and 46.

Now, considering the mode of operatin of the press, it will be assumed that it is desired to clamp the pads 56 as shown in FIG. 2. Accordingly, the user of the press holds the two handles 22 and 24, and raises the upper press plate 12 and the associated pressure clamping assembly 40 high on the six vertically extending rods, and inserts the pads 56 between the press plates. In the interim the upper press plate is held in its raised position by the spring 26 at one end of the press assembly and the corresponding extension spring 58 at the other end of the press. Then the operator presses the upper press plate 12 downwardly into engagement with the pads 56 so that they are fairly snugly located between the upper press plate 12 and the lower press plate 14. The operator then takes the handle 60 which is normally in a position approximately 30° to the left of the vertical with reference to FIG. 1, and pulls it to the right to the clamping position as shown in FIG. 1.

The mode of operation of the pressure and clamping assembly 40 which is located immediately above the upper press plate 12, will now be considered. Initially, the action in moving the clamping lever 60 is divided into two distinct phases. During the first phase the clamping assembly 40 is firmly clamped to the threaded rods 48 and 50, which are located at opposite ends of the press assembly. The clamping assembly 40 includes a longitudinally extending steel bar 62. The longitudinally slidable clamping members 64 and 66 are slidably mounted in brackets 68 and 70, and brackets 72 and 74 for movement only along the axis of the steel bar 62. At the end of bar 64 in proximity to the threaded shaft 48 is the half-nut 76 which has threads which match those of the threaded shaft 48. A similar half-nut 78 is located on the outer end of slidable shaft 66 adjacent the threaded shaft 50.

Figure 4:
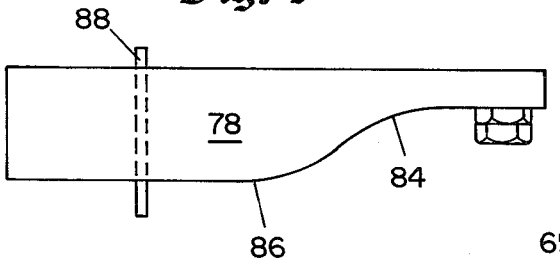
FIG. 4 is a detailed showing of one of the camming members forming part of the clamping assembly.

The spring 76 normally biases locking shaft 64 and its associated half nut 76 away from threaded shaft 48 and out of engagement with it. Spring 76 applies force to shaft 64 by bearing against pin 77 which extends through shaft 64. At an appropriate time in the operating cycle, the camming member 78 which is more completely shown in FIG. 4, forces shaft 64 to the left against the biasing force of spring 76 and locks shaft 64 to the threaded shaft 48. In operation, as the operating lever 60 is rotated, the shaft 80 upon which it is mounted also rotates, and an arm 82 which is fixed to the rotating shaft 80 slides the camming member 78 in a direction transverse to the extent of locking shaft 64. The relative position of the shaft 80, arm 82, and camming shaft 78 are best shown in FIG. 1. Under non-locking conditions, the shaft 64 engages the camming shaft 78 in the vicinity of region 84, see FIG. 4. However, after the actuating lever 60 has been moved 30°, or so, the locking shaft 64 rides up to region 86 on the camming member 78, and is forced outwardly into locking engagement with the threaded shaft 48.

The pin 88 retains the camming member in assembled position with its slide 90.

Simultaneously with the outward movement of shaft 64 into locking engagement with the threaded shaft 48, the shaft 66 at the other end of the locking and pressure assembly 40 is moved outward into engagement with the threaded shaft 50 under the control of the camming member 92.

Figure 5:
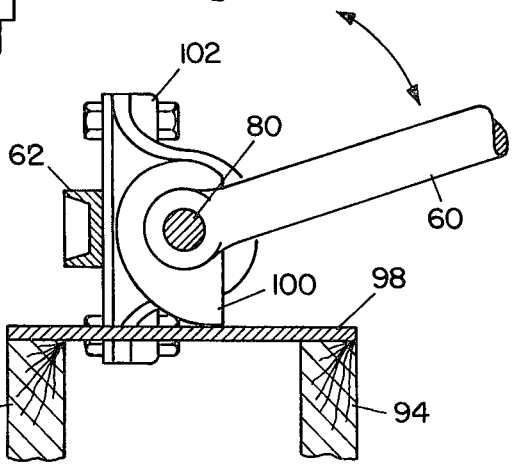
FIG. 5 is a partial cross-sectional view of the actuating lever and associated eccentric or camming surface which applies clamping force to the upper press plate.

Now, considering the final application of clamping pressure to the upper press plate 12 by the clamping assembly 40, attention is directed to FIG. 5. In FIG. 5, the wood bracing members 94 and 96 and the steel strip 98 are secured to the upper press plate 12. As mentioned above, the shaft 80 is firmly pinned to and rotates with the actuating lever 60. Secured to the shaft 80 is the cam 100 which bears directly on the steel strip 98. Incidentally, bracket 102 as shown in FIG. 5, and a corresponding additional bracket 104 on the other side of the operating lever 60, securely mount the rotatable shaft 80 to the transversely extending steel shaft 62 which forms the major cross-linking bridge of the clamping and pressure assembly 40.

Accordingly, the pressure clamping assembly 40 is initially firmly clamped to the threaded shafts 48 and 50 at the two ends of the press assembly, as the operating lever 60 is initially operated; thereafter, the cam 100 mentioned above, and the paired cam 106 apply firm downward pressure on the upper pressure plate 12, as the operating lever 60 is rotated through the remainder of its operating stroke.

In conclusion, a simple and easily operated press for light duty work has been disclosed. It provides easy manual vertical adjustment, and will retain the upper press plate in any position to which it has been set, so that work may be inserted between the press plates. Thereafter, the upper press plate is lowered manually to lightly but firmly engage the work which is to be clamped. Then, with a single complete stroke of the operating lever the upper clamping assembly is first locked in place, and then through additional camming action, firm pressure is applied to the work to be clamped. As mentioned above, the present press has found particular applicability in the gluing together of purchase order pads.

In closing, it is to be understood that minor variations of the particular mechanical movements which have been disclosed are still within the spirit and scope of the present invention. Thus, by way of specific example, instead of the threaded shafts and half-nuts which perform the vertical locking function, racks or other ribbed shafts, and wedge-type elements to engage the ribbed shafts could be used. Similarly, instead of the camming surfaces 100 and 106, eccentrics could be employed. Other minor mechanical variations are also included within the scope of the present invention.

What is claimed is:

1. A press comprising:

a fixed lower press plate;

a movable upper press plate;

a pressure clamping assembly associated with said movable upper press plate;

means for moving said upper press plate and said assembly, and for providing a stable vertical location for said upper press plate and said assembly to facilitate placing materials to be clamped beytween said plates with the plates in engagement with said material;

means for fixing the location of said pressure clamping assembly relative to said lower press plate;

means for forcing said upper press plate down with respect to said assembly; and single lever means for initially actuating said fixing means and thereafter actuating said forcing means, whereby said clamping pressure assembly is first held in vertical position and then applies clamping force to said upper press plate to firmly press said materials between said upper and lower press plates.

2. A press as defined in claim 1 wherein said forcing means includes a plurality of cams.

3. A press as defined in claim 1 wherein said pressure clamping assembly is separate from said upper press plate, and means are provided for mounting said pressure clamping assembly to normally rest on top of said upper press plate except during clamping operations.

4. A press as defined in claim 1 further comprising:

means for opposing the weight of said upper press plate and assembly to maintain the upper press plate in the location in which it is placed, and to facilitate adjustment of position of said upper press plate.

5. A press as defined in claim 4 wherein said means for opposing the weight of said press includes pivoted arms in a parallelogram-type arrangement, and an extension spring extending between two corners of said parallelogram.

6. A press as defined in claim 1 wherein said pressure clamping assembly includes vertically extending support members at each side of said press, at least one surface of said support members being provided with regular transversely extending ridges, and said fixing means includes transversely slidable means for engaging the ridges of said support members.

7. A press as defined in claim 1 wherein said pressure clamping assembly includes threaded vertically extending rods at each side of said press, and said fixing means includes transversely slidable means having curved ribs conforming to the threads on said rods for engaging said threaded rods.

8. A simplified light duty press comprising:

a fixed lower press plate;

an upper press plate movable over an extended vertical distance to facilitate clamping stacks of material of different thickness; and single lever operation means for initially substantially limiting the upward movement of said upper press plate, and subsequently forcing said two press plates together.

9. A press as defined in claim 8 further comprising a pair of vertically extending threaded rods, one located on each side of said press, and wherein said single lever operation means includes a pair of half-nut movable to engage said threaded rods.

10. A press as defined in claim 8 further comprising means for opposing the weight of said upper press plate and said single lever operation means, said opposing means including a parallelogram-type set of four linkage members having one pivot point secured to the upper press plate, the opposite pivot point connected to the lower press plate, and an extension spring extending between two opposite pivot points.

* * * * *